US010038265B1

(12) United States Patent
Roath et al.

(10) Patent No.: US 10,038,265 B1
(45) Date of Patent: Jul. 31, 2018

(54) LOW-PROFILE SURFACE MOUNTED RECEPTACLE

(71) Applicant: Ohio Associated Enterprises, LLC, Painesville, OH (US)

(72) Inventors: Alan L. Roath, Madison, OH (US); John T. Venaleck, Painesville, OH (US)

(73) Assignee: Ohio Associated Enterprises, LLC, Painesville, OH (US)

( * ) Notice: Subject to any disclaimer, the term of this patent is extended or adjusted under 35 U.S.C. 154(b) by 0 days.

(21) Appl. No.: 15/487,540

(22) Filed: Apr. 14, 2017

(51) Int. Cl.

| | |
|---|---|
| ***H01R 13/502*** | (2006.01) |
| ***H01R 13/11*** | (2006.01) |
| ***H01R 12/71*** | (2011.01) |
| ***H01R 13/405*** | (2006.01) |

(52) U.S. Cl.
CPC ..... *H01R 13/111* (2013.01); *H01R 12/716* (2013.01); *H01R 13/405* (2013.01)

(58) Field of Classification Search
CPC ..... H01R 13/512
USPC ..... 439/689, 690
See application file for complete search history.

(56) References Cited

U.S. PATENT DOCUMENTS 4,978,315 A * 12/1990 Edgley ..... H01R 4/4827 439/268

* cited by examiner

*Primary Examiner* — Phuong Dinh
(74) *Attorney, Agent, or Firm* — Renner, Otto, Boisselle & Sklar, LLP

(57) ABSTRACT

A very low profile connector (e.g., less than 1.9 mm high) utilizes stored energy in a horizontal beam to augment contact displacement and is contained in a cage that will eliminate any transfer of forces to the solder joints that hold the connector to the circuit board.

18 Claims, 4 Drawing Sheets

LOW-PROFILE SURFACE MOUNTED RECEPTACLE

FIELD OF THE INVENTION

The invention is in the field of electrical connectors for electronic circuit boards.

DESCRIPTION OF THE RELATED ART

In the field of electronic circuit boards, there is a need to conserve space and to limit the addition of losses, a low profile socket that will allow repeated entry of small electronic devices is needed. Usually some combination of vertical beams have been employed to craft a contact that will function as a compliant member that clamps the lead of an electronic device and electrically transmits electrical signals to the circuit board to which it is soldered. Especially with surface mounted solder joints, it has often been a challenge to isolate forces generated at the contact beam from affecting the integrity of the solder joint. Any forces at the joint will eventually fail the mechanical integrity of that joint as the solder cannot resist long-term because it will creep.

SUMMARY OF THE INVENTION

According to an aspect of the invention, an electrical connector includes: a connector housing having holes therein for receiving pins of a device; and contacts within the housing, wherein the contacts each include a beam bent downward from a top portion, to engage the pins inserted into the holes.

According to an embodiment of any paragraph(s) of this summary, the top portions of the contacts have respective holes for receiving portions of the housing, for heat staking of the contacts to the housing.

According to an embodiment of any paragraph(s) of this summary, the connector housing is made of plastic.

According to an embodiment of any paragraph(s) of this summary, the contact is made of sheet metal.

According to an embodiment of any paragraph(s) of this summary, for each of the contacts the beam is outside of the hole at a proximal end where the beam contacts the top portion, and the beam is within the hole at a distal free end.

According to an embodiment of any paragraph(s) of this summary, for each of the contacts the beam is at a small angle, such as from 5 to 10 degrees, relative to a vertical direction that is perpendicular to a horizontal beam of the top portion.

According to an embodiment of any paragraph(s) of this summary, each of the contacts has a pair of sides that bend down from the top portion, on opposite sides of the hole that corresponds to the contact.

According to an embodiment of any paragraph(s) of this summary, the contact housing includes a central body, and feet extending downward from the central body.

According to an embodiment of any paragraph(s) of this summary, the sides extend downward beyond a bottom surface of the central body.

According to an embodiment of any paragraph(s) of this summary, the feet have a height of 0.25 mm, or from 0.2 mm to 0.3 mm.

According to an embodiment of any paragraph(s) of this summary, the feet have a height sufficient to allow post-solder cleaning.

According to an embodiment of any paragraph(s) of this summary, the connector is in combination with a circuit board to which the electrical connector is mechanically coupled.

According to an embodiment of any paragraph(s) of this summary, the circuit board includes electrically conductive circuit pads located underneath respect of the holes.

According to an embodiment of any paragraph(s) of this summary, for each of the contacts the sides of the contact are soldered to one of the circuit pads.

According to an embodiment of any paragraph(s) of this summary, the connector body has chamfers around the holes.

According to an embodiment of any paragraph(s) of this summary, the connector has a height of 2 mm or less.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

In one embodiment a very low profile connector (less than 1.9 mm high, or more broadly less than 2 mm or 3 mm high) utilizes stored energy in a horizontal beam to augment contact displacement and is contained in a cage that will eliminate any transfer of forces to the solder joints that hold the connects to the circuit board.

The connector utilizes a metal cage, integral with a contact beam. The contact beam is in two parts, a horizontal portion and a vertical portion. The very short vertical portion generates a moment by virtue of the contact point being distal from the horizontal portion of the beam. The generated moment is absorbed throughout all elements of the beam and is finally transferred to the cage surrounding the contact beam.

The cage of the contact is affixed to a plastic housing that guides the pins of the device that is to be accommodated. The vertical portion of the beam urges the pin into a cavity in the housing designed to support the lateral forces generated. Lateral forces are absorbed in the housing by plastic protrusions that are heat staked to holes in the contact cage. All forces are thus contained in the housing cage pair; no external forces exist.

The connector is surface soldered to the circuit board at the two parallel rails that are a part of the contact cage. The example just cited and illustrated is for a simple two-pin device, although connectors and devices with other numbers of pins are possible as alternatives. Multiple pin devices can be accommodated by expanding these principles.

Figure 1:
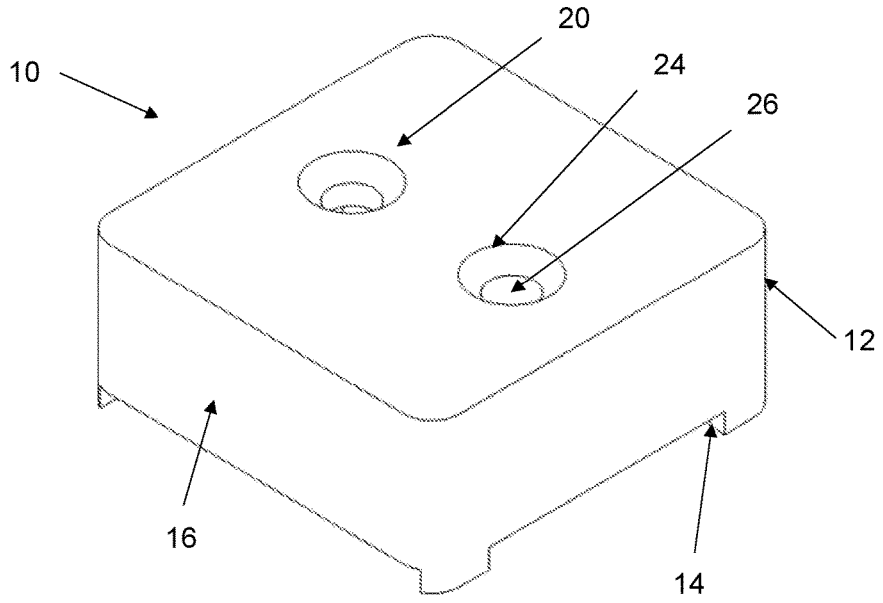
FIG. 1 is an isometric view of an electrical connector according to an embodiment of the invention.

FIG. 1 shows an isometric view of a preferred embodiment, a two-pin board-mounted connector 10. The connector 10 has a connector housing 12 with four (4) standoff feet 14 extending downward from a central body 16. The standoff feet 14 allow for clearance to the circuit board for post-solder cleaning. The feet 14 may have a height of 0.25 mm, to give one suitable value (although other heights may be used instead, such as from 0.2 mm to 0.3 mm, or from 0.1 mm to 0.4 mm), though other alternative heights for the feet 14 are possible. There are two ingress openings 20, with tapered lead-ins or chamfers 24, and with through-holes 26 that accommodate the pin leads of a typical two-pin electrical device. The housing 12 may be made of a suitable plastic, such as a moldable plastic. The tapered lead-ins 24 facilitate receipt of pins into the openings 20, urging slightly misaligned pins into the through-holes 26.

Figure 2:
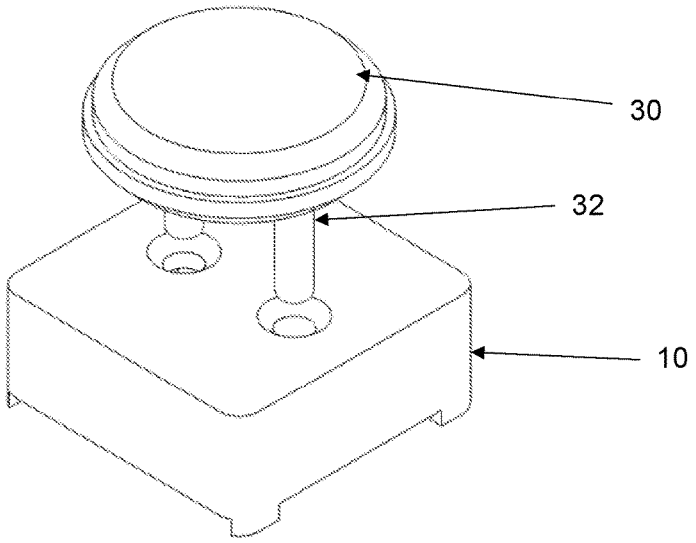
FIG. 2 is an exploded isometric view of the electrical connector of FIG. 1, along with a mating device.

FIG. 2 shows the two-pin device 30 about to enter the connector 10. The device 30 has connecting pins 32. The device 30 shown in representative of a variety of devices that have two pins 32 configured to be inserted into the holes or openings 20. The device 30 may be an electrical connection for connection to another device, may itself be an electrical or electronic device, and/or may be some other sort of two-pin device.

Figure 3:
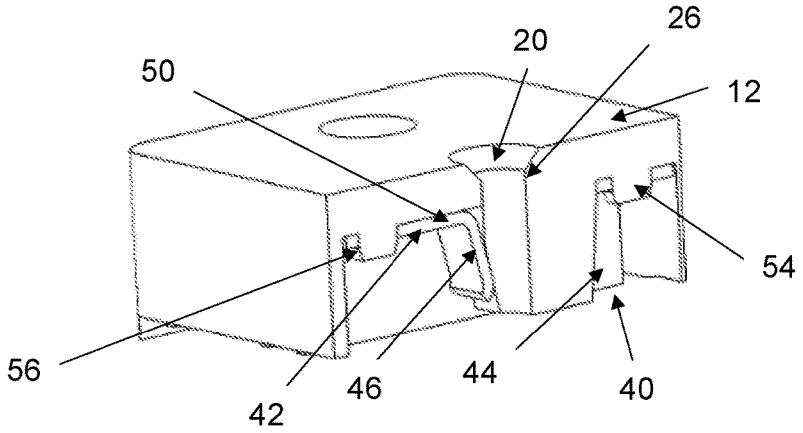
FIG. 3 is a sectional view of the electrical connector of FIG. 1.

FIG. 3 is a sectioned view of the connector 10 through the center of one of the pin ingress holes 20. The view reveals one of the two embedded electrically-conductive contacts 40 that are part of the connector 12. The contacts 40 each have a folded-over U-shape that provide electrical isolation of the inserted pins 32 (FIG. 2), when the device 30 (FIG. 2) is engaged with the connector 10. Each of the contacts 40 includes a top portion 42, and a pair of side portions or solder rails 44 folded down from the top portion 42. The contacts 40 provide electrical isolation of the pins 32 from one another, and from the pins 32 and objects external to the connector 10. Also shown is a vertical (sloped in a mainly vertical direction) portion of the contact beam 46, and the corresponding horizontal portion of the beam 50 (part of the contact top portion 42). Although the beam 46 is described in some places herein as "vertical," it is actually at a nonzero angle relative to the vertical direction (the direction perpendicular to the horizontal beam 50), for example being at an angle of 5 to 10 degrees relative to the vertical direction, so as to extend further into the ingress opening 20 the further along the beam 46 from its proximal end (where it is bent down from the contact top portion 42), to its distal (free) end. This range of angles is only an example, and other suitable angles may be used instead.

Two heat stake posts, a detail of the housing 12, are shown at 54. These posts 54 fix the contact 40 to the housing 12. The posts 54 are integral parts of the housing 12 as molded, and pass through holes 56 in the top portion 42 of the contacts 40 to allow heat staking of the housing 12 to contacts 40. The contact beams 46 are integral parts of the contacts 40, cut from the rest of the contacts 40 (specifically from the top (horizontal) portions or beams 50) and bent downward at an angle to the horizontal beams 50 of the contacts 40. The contacts 40 may be made from suitable sheet metal, such as sheet copper or sheet steel. The contacts 40 may be formed by suitable stamping operations, for example, or other suitable operations.

Figure 4:
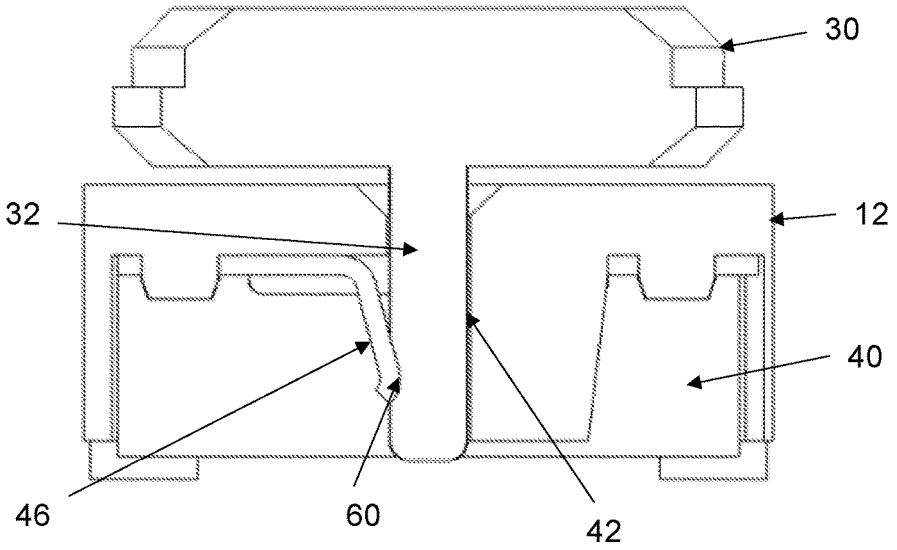
FIG. 4 is a sectional view of the electrical connector of FIG. 1, mated with the device of FIG. 2.

FIG. 4 shows the same section view as FIG. 3, but with the two-pin electrical device 30 installed. Of note is the interference 60 of the vertical beam 46 and the pin 32 of the two-pin electrical device 30. This interference at 60 deflects the beam 46 as the pin 32 is pushed into the housing 3, shown at 62. The residual force created by the deflection of the beam 46 at the interference 60 will result in a normal force that constitutes the electrical connection of the pin to the contact 40. The vertical (or vertically sloped) member, the beam 46, generates a moment that is transferred to the horizontal member, the top portion 42 of the contact 40.

Figure 5:
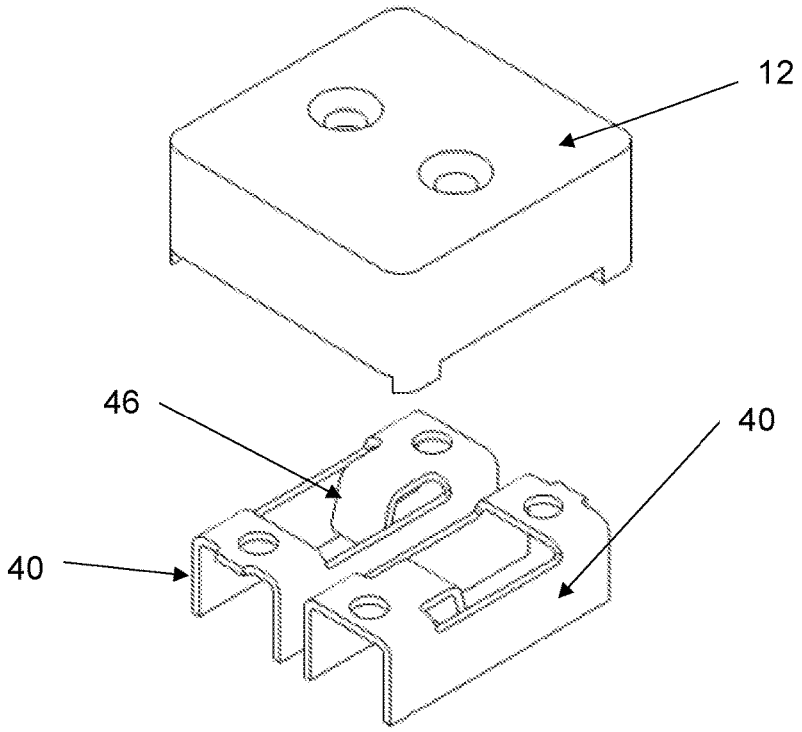
FIG. 5 is an exploded view showing details of the electrical connector of FIG. 1.

FIG. 5 is an exploded view showing the two contacts 40 that occupy the housing 12. The vertical (sloped) positions of the contact beams 46 are shown in FIG. 5 as opposing each other. This opposite orientation is optional, and no functional difference will occur if the contacts 40 are installed with the same orientation.

Figure 6:
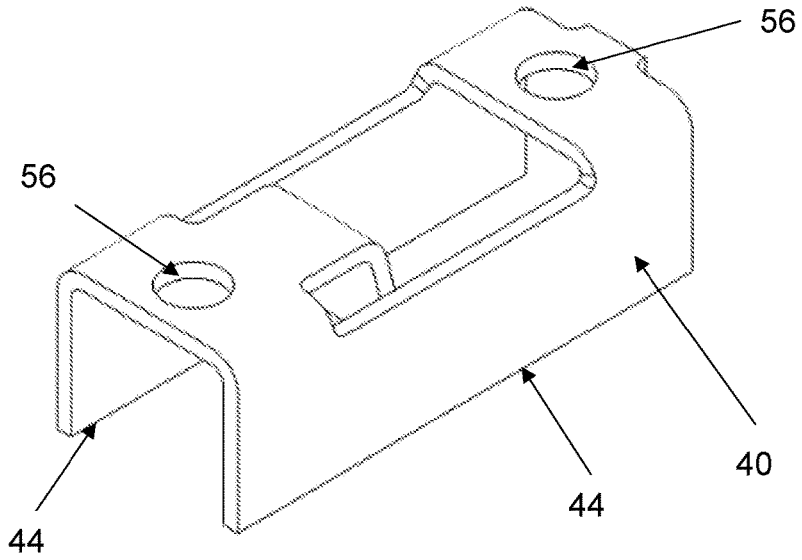
FIG. 6 is an isometric view of one of the contacts of the electrical connector of FIG. 1.

FIG. 6 is an isometric view of the contact 40. The top portion 42 include the holes 56 through which the heat stake posts 54 of FIG. 3 are inserted. Also shown are the two (2) solder rails 44, the downward bent side portions of the contacts 40. The solder rails 44 extend below the bottom of main part of the connector housing 12 (as best shown in FIG. 3), into the region supported by the standoff feet 14 (FIG. 3). This enables the solder rails 44 to be soldered to the solder pads of a circuit board, as described below.

Figure 7:
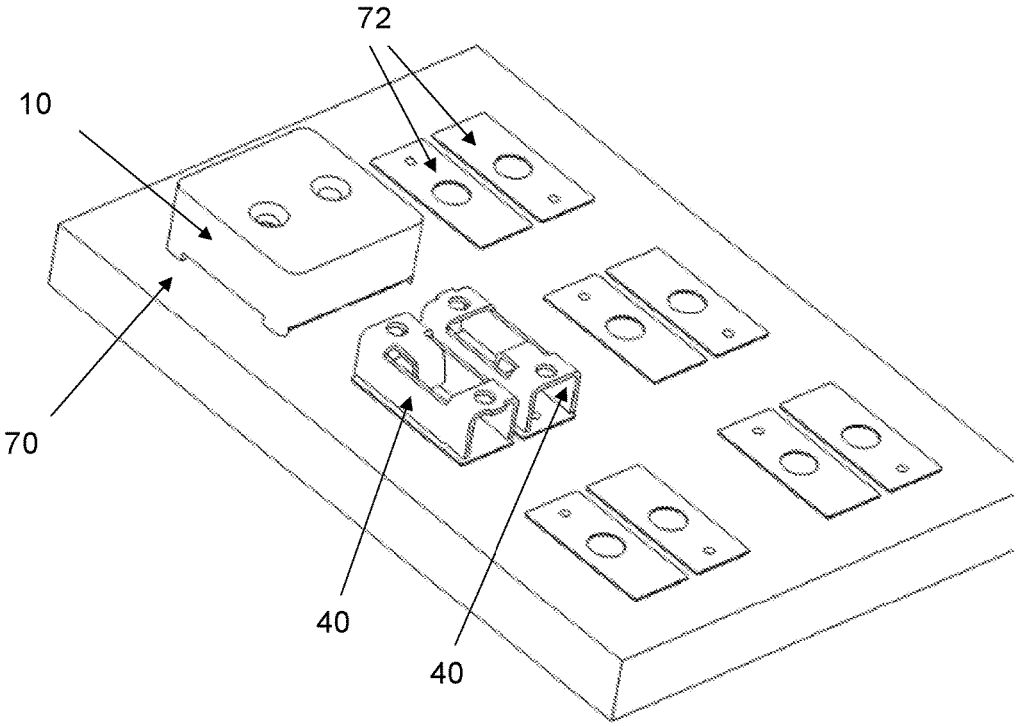
FIG. 7 is oblique view of a circuit board, with the electrical connector of FIG. 1 mounted on the board.

FIG. 7 shows a typical circuit board 70 with circuit pads or solder pads 72. Also shown is a two-pin connector in the position of a pair of circuit pads and a second connector contact pair 40 with the housing removed. The feet 14 support the connector housing 12. As noted above, the solder rails 44 extend down below the main part of the housing 12, with the solder rails 44 able to be soldered to the circuit pads 72 to hold the connector 10 to the circuit board 70, and to provide a more complete cage for electrically isolating the pins 32 (FIG. 2) of the device 30 (FIG. 2).

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electrical connector comprising:

a connector housing having holes therein for receiving pins of a device; and contacts within the housing, wherein the contacts each include a beam bent downward from a top portion, to engage the pins inserted into the holes;

wherein the top portions of the contacts have respective holes for receiving portions of the housing, for heat staking of the contacts to the housing.

2. The electrical connector of claim 1, wherein the connector housing is made of plastic; and wherein the contact is made of sheet metal.

3. The electrical connector of claim 1, wherein for each of the contacts the beam is outside of the hole at a proximal end where the beam contacts the top portion, and the beam is within the hole at a distal free end.

4. The electrical connector of claim 1, wherein for each of the contacts the beam is at an angle of from 5 degrees to 10 degrees, relative to a vertical direction that is perpendicular to a horizontal beam of the top portion.

5. An electrical connector comprising:

a connector housing having holes therein for receiving pins of a device; and contacts within the housing, wherein the contacts each include a beam bent downward from a top portion, to engage the pins inserted into the holes;

wherein each of the contacts has a pair of sides that bend down from the top portion, on opposite sides of the hole that corresponds to the contact.

6. The electrical connector of claim 5, wherein the contact housing includes a central body, and feet extending downward from the central body; and wherein the sides extend downward beyond a bottom surface of the central body.

7. The electrical connector of claim 6, wherein the feet have a height of 0.25 mm or more.

8. The electrical connector of claim 6, in combination with a circuit board to which the electrical connector is mechanically coupled.

9. The combination of claim 8, wherein the circuit board includes electrically conductive circuit pads located underneath respect of the holes.

10. The combination of claim 9, wherein for each of the contacts the sides of the contact are soldered to one of the circuit pads.

11. The electrical connector of claim 1, wherein the connector body has chamfers around the holes.

12. The electrical connector of claim 1, wherein the connector has a height of 2 mm or less.

13. The electrical connector of claim 5, wherein the top portions of the contacts have respective holes for receiving portions of the housing, for heat staking of the contacts to the housing.

14. The electrical connector of claim 5, wherein the connector housing is made of plastic; and wherein the contact is made of sheet metal.

15. The electrical connector of claim 5, wherein for each of the contacts the beam is outside of the hole at a proximal end where the beam contacts the top portion, and the beam is within the hole at a distal free end.

16. The electrical connector of claim 5, wherein for each of the contacts the beam is at an angle of from 5 degrees to 10 degrees, relative to a vertical direction that is perpendicular to a horizontal beam of the top portion.

17. The electrical connector of claim 5, wherein the connector body has chamfers around the holes.

18. The electrical connector of claim 5, wherein the connector has a height of 2 mm or less.

* * * * *